US008030846B2

(12) United States Patent
Kang et al.

(10) Patent No.: US 8,030,846 B2
(45) Date of Patent: Oct. 4, 2011

(54) DISCHARGE VALVE ASSEMBLY FOR LINEAR COMPRESSOR

(75) Inventors: Kyoung-Seok Kang, Changwon-si (KR); Yangjun Kang, Changwon-si (KR); Min-Woo Lee, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 599 days.

(21) Appl. No.: 12/087,771

(22) PCT Filed: Jan. 16, 2007

(86) PCT No.: PCT/KR2007/000268

§ 371 (c)(1), (2), (4) Date: Dec. 12, 2008

(87) PCT Pub. No.: WO2007/081192

PCT Pub. Date: Jul. 19, 2007

(65) Prior Publication Data

US 2009/0220365 A1 Sep. 3, 2009

(30) Foreign Application Priority Data

Jan. 16, 2006 (KR) ..... 10-2006-0004642

(51) Int. Cl.
*F04B 39/10* (2006.01)
*F04B 53/10* (2006.01)

(52) U.S. Cl. ..... 313/570; 313/559; 313/569

(58) Field of Classification Search ..... 417/559, 417/569, 570

See application file for complete search history.

(56) References Cited

U.S. PATENT DOCUMENTS

2002/0150488 A1* 10/2002 Lee et al. ..... 417/569
2003/0133816 A1* 7/2003 Park et al. ..... 417/540

FOREIGN PATENT DOCUMENTS

JP 2005-226489 8/2005
WO WO 2006052110 A1 * 5/2006

* cited by examiner

*Primary Examiner* — Nimeshkumar Patel
*Assistant Examiner* — Glenn Zimmerman
(74) *Attorney, Agent, or Firm* — McKenna Long & Aldridge LLP

(57) ABSTRACT

The present invention discloses a discharge valve assembly for a linear compressor, comprising: a discharge valve installed at one end of the cylinder to be opened and closed, a compression space for compressing a sucked refrigerant by linear reciprocation of a piston being formed in one end of the cylinder; a discharge cap fixedly installed at one end of the cylinder, for forming a discharge space to which the refrigerant of the compression space is discharged; a discharge valve spring installed between the discharge valve and the discharge cap, for opening and closing the discharge valve according to a refrigerant pressure; and a ring-shaped discharge valve supporter installed in the discharge cap, having at least one main protrusion directly contacting the inner circumference of the discharge cap and at least one auxiliary protrusion disposed with an interval from the inner circumference of the discharge cap being formed on the outer circumference of the discharge valve supporter.

10 Claims, 3 Drawing Sheets

[Fig. 1]
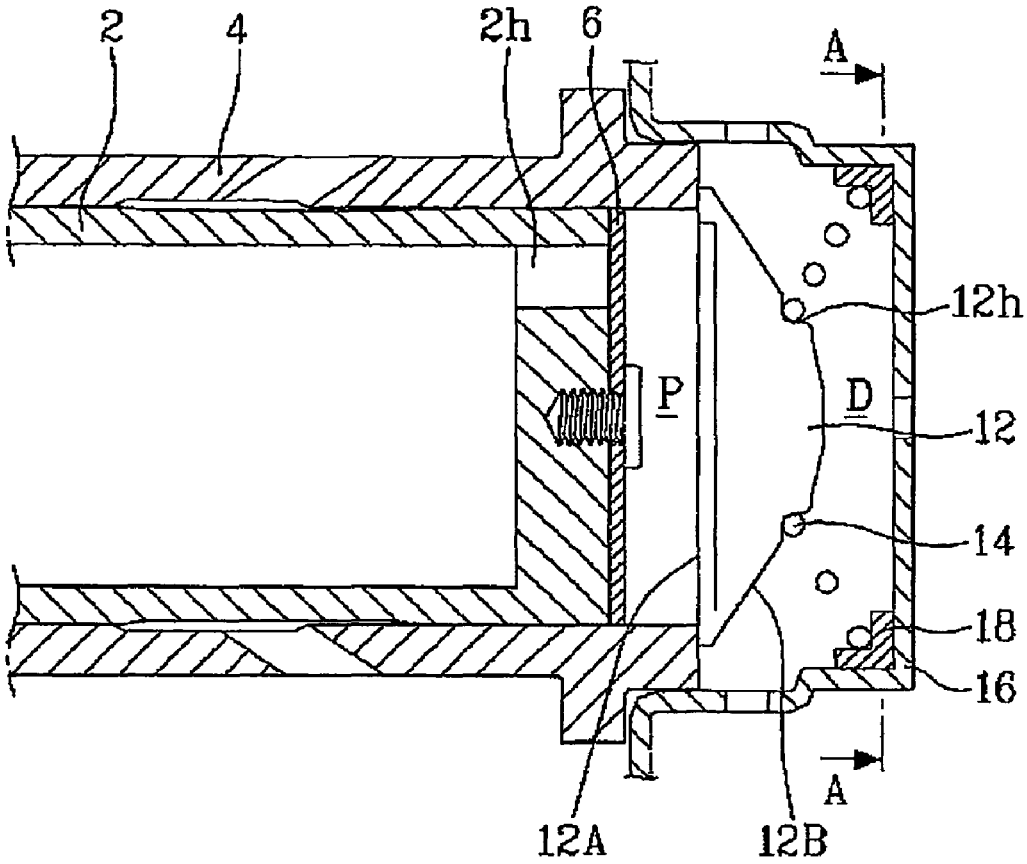
[Fig. 2]
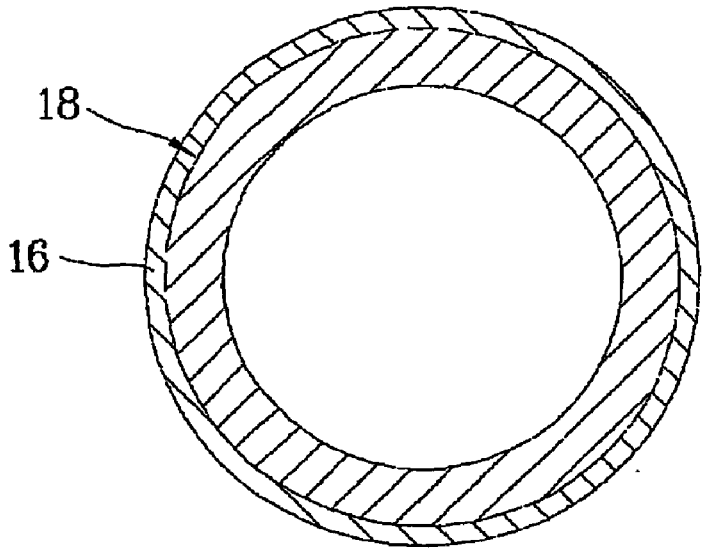

[Fig. 3]
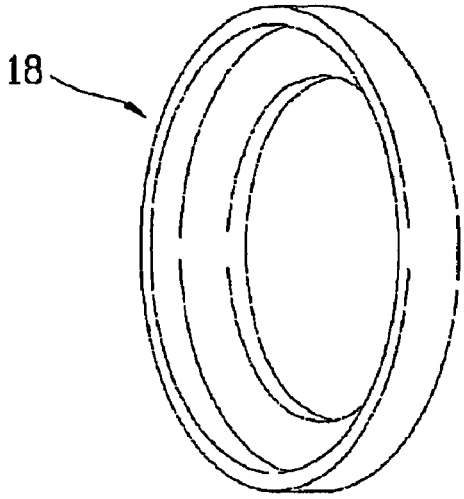
[Fig. 4]
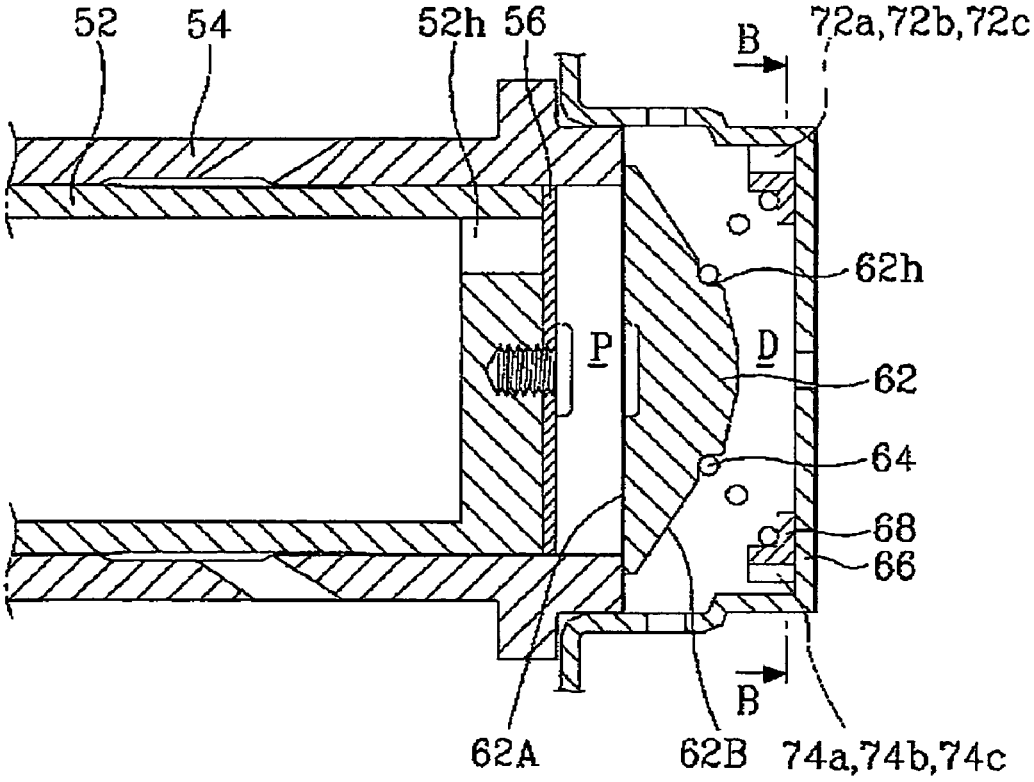

[Fig. 5]
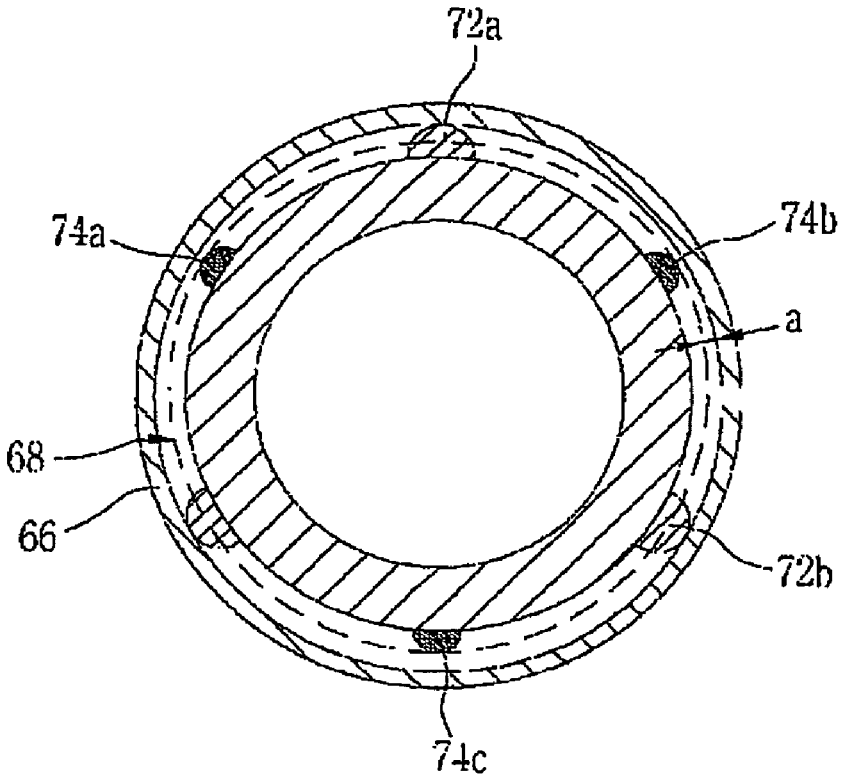
[Fig. 6]
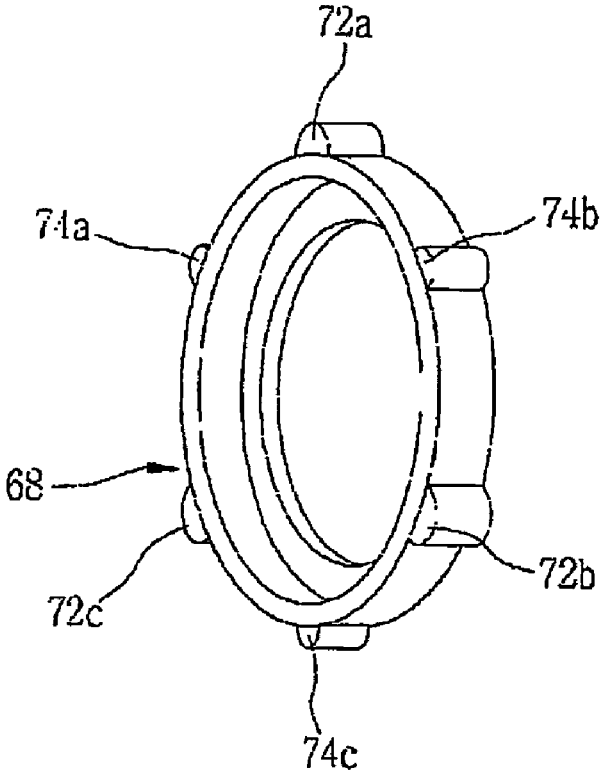

DISCHARGE VALVE ASSEMBLY FOR LINEAR COMPRESSOR

This application claims priority to International application No. PCT/KR2007/000268 filed on Jan. 16, 2007 which claims priority to Korean Application No. 10-2006-0004642 filed Jan. 16, 2006, both of which are incorporated by reference, as if fully set forth herein.

TECHNICAL FIELD

The present invention relates to a discharge valve assembly for a linear compressor which includes a discharge valve installed at one end of a cylinder and opened and closed by a discharge valve spring, for compressing a refrigerant sucked into a compression space by linear reciprocation of a piston inside the cylinder, and discharging the compressed refrigerant to a discharge space, and more particularly, to a discharge valve assembly for a linear compressor which can efficiently reduce abrasion by friction and restrict vibration transfer, even if vibration between a piston and a cylinder is transferred through a discharge valve spring to generate an external force.

BACKGROUND ART

FIG. 1 is a side-sectional view illustrating a conventional discharge valve assembly for a linear compressor, FIG. 2 is a cross-sectional view taken along line A-A of FIG. 1, and FIG. 3 is a perspective view illustrating a discharge valve supporter applied to the conventional discharge valve assembly or the linear compressor.

Referring to FIG. 1, in the conventional discharge valve assembly for the linear compressor, a piston 2 is driven by a linear motor (not shown) and linearly reciprocated inside a cylinder 4, so that a refrigerant sucked into a compression space P formed between the piston 2 and the cylinder 4 can be compressed and discharged into a discharge space D formed at one end of the cylinder 4. A discharge valve 12 is installed to block one end of the cylinder 4. A discharge cap 16 is installed at one end of the cylinder 4 to form the discharge space D, and a ring-shaped discharge valve supporter 18 is stably installed inside the discharge cap 16. A spiral discharge valve spring 14 is installed between the discharge valve 12 and the discharge cap 16, for opening and closing the discharge valve 12 according to a pressure inside the compression space P.

A hole for sucking the refrigerant into the compression space P is formed at the end of the piston 2, and a thin plate type suction valve 6 for opening and closing the hole is screw-fixed to the end of the piston 2. The discharge valve assembly comprising the discharge valve 12, the discharge valve spring 14, the discharge valve supporter 18 and the discharge cap 16 is installed at one end of the cylinder 4, for discharging the refrigerant from the compression space P. The suction valve 6 and the discharge valve assembly are opened and closed according to the pressure inside the compression space P.

Here, one surface 12A of the discharge valve 12 is formed flat to contact closely to one end of the cylinder 4, and the opposite surface 12B thereof is upwardly protruded toward the center, namely, convex. A settling groove 12*h* is steppedly formed at the center portion of the surface 12B, so that one end of the discharge valve spring 14 can be settled in the settling groove 12*h*.

A spiral coil spring is used as the discharge valve spring 14. One end of the discharge valve spring 14 with a small diameter is settled on the discharge valve 12, and the other end of the discharge valve spring 14 with a large diameter is supported by the discharge valve supporter 18.

The discharge cap 16 is formed in a circular cap shape. One end of the discharge cap 16 is fixedly coupled to one end of the cylinder 4. A refrigerant discharge tube (not shown) for externally guiding the refrigerant is connected to one side of the discharge cap 16. As illustrated in FIGS. 2 and 3, the discharge valve supporter 18 is firmed in a ring shape with an L-shaped section, and disposed to surface-contact the inner edge portion of the discharge cap 16.

The discharge valve spring 14 is made of a metal material with high rigidity. Even if the compression space P maintains a high pressure, the discharge valve spring 14 can push the discharge valve 12 toward one end of the cylinder 4. In addition, the discharge cap 16 is made of a metal material with high rigidity. Accordingly, when the high pressure refrigerant compressed in the compression space P is temporarily stored inside the discharge cap 16, the discharge cap 16 can resist the high pressure. In order to prevent the discharge valve spring 14 from directly contacting the discharge cap 16, the discharge valve supporter 18 made of a ductile material is installed inside the discharge cap 16.

The process of discharging the refrigerant will now be explained. When the piston 2 is linearly reciprocated inside the cylinder 4, if the pressure inside the compression space P is below a set discharge pressure, the discharge valve 12 contacts closely to one end of the cylinder 4 by an elastic force of the discharge valve spring 14, thereby preventing discharge of the refrigerant. Conversely, if the pressure inside the compression space P is over the set discharge pressure, the discharge valve spring 14 is compressed to make the discharge valve 12 open one end of the cylinder 14, thereby discharging the compressed refrigerant.

In the conventional discharge valve assembly for the linear compressor, the discharge valve 12 is installed at one end of the cylinder 4 and opened and closed by the discharge valve spring 14. One end of the discharge valve spring 14 is supported by the discharge valve 12, and the other end thereof is supported by the discharge cap 16 fixed to one end of the cylinder 4 and the discharge valve supporter 18 settled in the discharge cap 16. As a result, vibration generated by linear reciprocation of the piston 2 inside the cylinder 4 is transferred to the discharge valve supporter 18 and the discharge cap 16 surface-contacting the discharge valve supporter 18 through the discharge valve spring 14, and amplified to increase noise.

DISCLOSURE OF INVENTION

Technical Problem

An object of the present invention is to provide a discharge valve assembly for a linear compressor which can prevent vibration generated by linear reciprocation of a piston inside a cylinder from being amplified and transferred through a discharge valve spring, and maintain operation stability regardless of variation of an external force by the vibration.

Technical Solution

There is provided a discharge valve assembly for a linear compressor which discharges a refrigerant compressed by a piston linearly reciprocated inside a cylinder, the discharge valve assembly, including: a discharge valve installed at an end of the cylinder to be opened and closed; a discharge cap fixedly installed at the end of the cylinder, for covering the cylinder and the discharge valve; a discharge valve spring installed between the discharge valve and the discharge cap, for opening and closing the discharge valve according to a refrigerant pressure; and a discharge valve supporter installed in the discharge cap, having at least one main protrusion contacting the inner circumference of the discharge cap and at least one auxiliary protrusion isolated from the inner circumference of the discharge cap being formed on the outer circumference of the discharge valve supporter. By this constitution, when the compressor is normally operated, only the main protrusions contact the discharge cap, and when an external force is excessively applied by the discharge valve, the main and auxiliary protrusions contact the discharge cap to reduce vibration transfer by the discharge valve.

In another aspect of the present invention, the plurality of main protrusions and the plurality of auxiliary protrusions are formed in point-symmetric positions on the outer circumference of the discharge valve supporter, respectively. By this constitution, vibration transferred by the discharge valve can be distributed to the whole discharge valve supporter.

In another aspect of the present invention, the plurality of main protrusions and the plurality of auxiliary protrusions are alternately formed on the outer circumference of the discharge valve supporter at intervals. For one example, three main protrusions are formed on the outer circumference of the discharge valve supporter at an interval of 120, and three auxiliary protrusions are formed between the three main protrusions. For another example, four main protrusions are formed at an interval of 90, and four auxiliary protrusions are formed between the four main protrusions.

In another aspect of the present invention, the main protrusions and the auxiliary protrusions are elongated in the axial direction of the discharge valve supporter. By this constitution, the main protrusions and the auxiliary protrusions are formed at intervals not to interfere with each other. In addition, the contact area of the discharge valve supporter to the discharge cap is relatively widened.

In another aspect of the present invention, the discharge valve supporter is made of a ductile material. By this constitution, the discharge valve supporter is easily installed in the discharge cap, and the main protrusions and the auxiliary protrusions are elastically transformed to reduce noise and vibration generated by motion of the discharge valve.

In another aspect of the present invention, the discharge valve supporter is formed in a ring shape with an L-shaped section. By This constitution, the contact area of the discharge valve supporter to the discharge cap can be widened, so that the discharge valve supporter can be installed in the discharge cap with strong adhesiveness.

In another aspect of the present invention, the discharge valve supporter is firmed in an opened ring shape with an L-shaped section. By this constitution, the discharge valve supporter is flexibly bent, and thus easily installed in the discharge cap.

In another aspect of the present invention, the main protrusions and the auxiliary protrusions have a pattern, and the pattern forms 120 rotation symmetry, respectively. For example, the pattern can be embodied by various combinations, such as one main protrusion and one auxiliary protrusion, two main protrusions and one auxiliary protrusion, and two main protrusions and two auxiliary protrusions. As the pattern forms 120 rotation symmetry, an external force by the main protrusions and the auxiliary protrusions is evenly distributed to the whole discharge valve supporter and the whole discharge cap.

The auxiliary protrusions are formed in at least two sizes with different intervals from the inner circumference of the discharge cap. For example, when the plurality of auxiliary protrusions are formed in different sizes, they can efficiently cope with various strengths of external force applied by the discharge valve.

The outside diameter of the discharge valve supporter is larger than the inside diameter of the discharge cap. By this constitution, the discharge valve supporter can be firmly adhered to the discharge cap.

Advantageous Effects

In accordance with the present invention, the discharge valve assembly for the linear compressor includes the discharge valve, the discharge valve spring, the discharge valve supporter and the discharge cap, and the main protrusions contacting the inner circumference of the discharge cap and the auxiliary protrusions maintaining a interval from the inner circumference of the discharge cap are alternately formed on the outer circumference of the discharge valve supporter. Even if vibration generated by opening and closing of the discharge valve is transferred to the discharge valve spring to apply the external force to the discharge valve supporter, the main protrusions line-contact the discharge cap to prevent amplification and transfer of vibration and noise. Furthermore, even if the external force is excessively applied to the discharge valve supporter to deform the main protrusions, the auxiliary protrusions contact the discharge cap to prevent excessive deformation of the main protrusions, thereby maintaining the uniform contact area and dispersing the external force to various portions. As a result, stability and reliability of the product are improved.

BRIEF DESCRIPTION OF THE DRAWINGS

FIG. 1 is a side-sectional view illustrating a conventional discharge valve assembly or a linear compressor;

FIG. 2 is a cross-sectional view taken along line A-A of FIG. 1;

FIG. 3 is a perspective view illustrating a discharge valve supporter applied to the conventional discharge valve assembly for the linear compressor;

FIG. 4 is a side-sectional view illustrating a discharge valve assembly for a linear compressor in accordance with the present invention;

FIG. 5 is a cross-sectional view taken along line B-B of FIG. 4; and

FIG. 6 is a perspective view illustrating a discharge valve supporter applied to the discharge valve assembly for the linear compressor in accordance with the present invention.

MODE FOR THE INVENTION

The present invention will now be described in detail with reference to the accompanying drawings.

FIG. 4 is a side-sectional view illustrating the discharge valve assembly for the linear compressor in accordance with the present invention, FIG. 5 is a cross-sectional view taken along line B-B of FIG. 4, and FIG. 6 is a perspective view illustrating a discharge valve supporter applied to the discharge valve assembly for the linear compressor in accordance with the present invention.

As illustrated in FIG. 4, in the discharge valve assembly for the linear compressor, a piston 52 is linearly reciprocated inside a cylinder 54, for compressing a refrigerant. A discharge valve 62 is installed at one end of the cylinder 54, for opening and closing the cylinder 54. A discharge cap 66 is fixedly installed at one end of the cylinder 54, for covering the cylinder 54 and the discharge valve 62. One end of a spiral discharge valve spring 64 elastically supports the discharge valve 62. The other end of the discharge valve spring 64 is settled in the discharge cap 66 to contact a ring-shaped discharge valve supporter 68 and main protrusions 72*a*, 72*b* and 72*c* incorporated with the outer circumference of the discharge valve supporter 68. In a state where an external force is not applied to the discharge valve supporter 68, auxiliary protrusions 74*a*, 74*b* and 74*c* do not contact the discharge cap 66 with an interval from the discharge cap 66. Hereinafter, the space formed by the cylinder 54, the piston 52 and the discharge valve 62 is referred to as a compression space P, and the space formed by the cylinder 54, the discharge valve 62 and the discharge cap 66 is referred to as a discharge space D.

The piston 52 is linearly reciprocated inside the cylinder 54 by a linear motor (not shown). The compression space P for compressing the refrigerant is formed between the piston 52 and the cylinder 54. A hole 52*h* for sucking the refrigerant into the compression space P is formed at one end of the piston 52, and a thin plate type suction valve 56 for opening and closing the hole 52*h* is installed on the hole 52*h*.

One surface 62A of the discharge valve 62 is formed flat to block one end of the cylinder 54, and the opposite surface 62B thereof is upwardly protruded toward the center, namely, convex. A ring-shaped settling groove 62*h* is steppedly formed at the center portion of the surface 62B, so that one end of the discharge valve spring 64 can be settled in the settling groove 62*h*.

The discharge valve 62 is made of a PEEK material which is a kind of engineering plastic to resist a pressure applied from the compression space P and the discharge space D and to contact closely to one end of the cylinder 54.

A spiral coil spring is used as the discharge valve spring 64. One end of the discharge valve spring 64 with a small diameter is supported by the discharge valve 62, and the other end of the discharge valve spring 64 with a large diameter is supported by the discharge valve supporter 68.

Preferably, the discharge valve spring 64 is made of a metal material with high rigidity. Therefore, even if a pressure inside the compression space P is high, the discharge valve spring 64 can push the discharge valve 62 toward one end of the cylinder 54.

The discharge cap 66 is formed in a cap shape. The opened end of the discharge cap 66 is fixed to the outer circumference of one end of the cylinder 54. The discharge space D into which the high pressure refrigerant is discharged is formed inside the discharge cap 66. A refrigerant discharge tube (not shown) for externally discharging the high pressure refrigerant is connected to one side of the discharge cap 66.

Preferably, the discharge cap 66 is made of a metal material with sufficient rigidity to resist the high pressure inside the discharge space D.

As shown in FIGS. 5 and 6, the discharge valve supporter 68 is formed in a ring shape with an L-shaped section. For example, the outside diameter of the discharge valve supporter 68 is identical to the inside diameter of the discharge cap 66, so that the discharge valve supporter 68 can be stably positioned inside the discharge cap 66. Preferably, the discharge valve supporter 68 is made of a ductile material such as Teflon to perform buffering between the metal materials, namely, the discharge valve spring 64 and the discharge cap 66.

On the other hand, the size and shape of the discharge valve supporter 68 may be deformed due to the thermal treatment of the manufacturing process. Moreover, since the main protrusions 72*a*, 72*b* and 72*c* and the auxiliary protrusions 74*a*, 74*b* and 74*c* are formed on the outer circumference of the discharge valve supporter 68, it is difficult to precisely position the discharge valve supporter 68 in the discharge cap 66. Accordingly, as another example, the outside diameter of the discharge valve supporter 68 is set larger than the inside diameter of the discharge cap 66, and the discharge valve supporter 68 is formed in an opened ring shape by cutting some section in the circumferential direction.

As described above, the discharge valve supporter 68 is made of a ductile material. Therefore, in a state where both ends of the cut section are adhered to each other, the discharge valve supporter 68 can be inserted into the discharge cap 66. Although the size and shape of the discharge valve supporter 68 are changed due to the thermal treatment of the manufacturing process, or the main protrusions 72*a*, 72*b* and 72*c* and the auxiliary protrusions 74*a*, 74*b* and 74*c* are formed on the outer circumference of the discharge valve supporter 68, the discharge valve supporter 68 can be easily coupled into the discharge cap 66.

Especially, the main protrusions 72*a*, 72*b* and 72*c* and the auxiliary protrusions 74*a*, 74*b* and 74*c* are protruded from the outer circumference and/or outer edges of the discharge valve supporter 68 contacting the discharge cap 66, and incorporated with the discharge valve supporter 68. The main protrusions 72*a*, 72*b* and 72*c* and the auxiliary protrusions 74*a*, 74*b* and 74*c* are elongated in the axial direction from the outer circumference of the discharge valve supporter 68 to contact the discharge cap 66, thereby increasing the contact area.

The main protrusions 72*a*, 72*b* and 72*c* and the auxiliary protrusions 74*a*, 74*b* and 74*c* are provided in a multiple number at intervals in the circumferential direction of the discharge valve supporter 68. Here, the main protrusions 72*a*, 72*b* and 72*c* and the auxiliary protrusions 74*a*, 74*b* and 74*c* are alternately formed on the outer circumference of the discharge valve supporter 68, so that the discharge valve supporter 68 can be stably supported in the discharge cap 66.

The main protrusions 72*a*, 72*b* and 72*c* are protruded higher than the auxiliary protrusions 74*a*, 74*b* and 74*c*. The apexes of the main protrusions 72*a*, 72*b* and 72*c* contact the inner circumference of the discharge cap 66, but the apexes of the auxiliary protrusions 74*a*, 74*b* and 74*c* have a interval (a) from the inner circumference of the discharge cap 66.

If vibration is transferred to the discharge valve spring 64 to generate an external force, the discharge valve supporter 68 made of a ductile material is deformed. In consideration of the deformation, the size of the main protrusions 72*a*, 72*b* and 72*c* is determined so that the main protrusions 72*a*, 72*b* and 72*c* can contact the discharge cap 66 regardless of the external force. Meanwhile, the size of the auxiliary protrusions 74*a*, 74*b* and 74*c* is determined so that the auxiliary protrusions 74*a*, 74*b* and 74*c* can maintain the interval (a) from the discharge cap 66 and contact the discharge cap 66 over a predetermined external force.

The interval (a) between the auxiliary protrusions 74*a*, 74*b* and 74*c* and the discharge cap 66 is determined in consideration of the rigidity of the materials of the discharge valve supporter 68 and the main protrusions 72*a*, 72*b* and 72*c*. If the discharge valve supporter 68 and the main protrusions 72*a*, 72*b* and 72*c* are made of materials easily deformable by the external force, the interval (a) is preferably set larger. In addition, if the axial length of the main protrusions 72*a*, 72*b* and 72*c* is long, the interval (a) between the auxiliary protrusions 74*a*, 74*b* and 74*c* and the discharge cap 66 is preferably set larger.

The operation of the discharge valve assembly for the linear compressor in accordance with the present invention will now be described.

The piston 54 is linearly reciprocated inside the cylinder 52 by the linear motor. As the pressure inside the compression space P is varied, the refrigerant is sucked and compressed. The compressed refrigerant is discharged by opening the discharge valve 62.

When the discharge valve 62 is opened or closed, if vibration is transferred to the discharge valve supporter 68 through the discharge valve spring 64 to generate the external force, the main protrusions 72*a*, 72*b* and 72*c* are elastically transformed to buffer the external force. Therefore, vibration and noise generated by the discharge valve 62 and transferred to the other components through the discharge cap 66 can be reduced.

Conversely, if the discharge valve 62 is abnormally opened or closed by an external factor, vibration is transferred to the discharge valve spring 64, and an external force is excessively applied to the discharge valve supporter 68. In this case, even if the main protrusions 72*a*, 72*b* and 72*c* are compressed and deformed, the auxiliary protrusions 74*a*, 74*b* and 74*c* contact the discharge cap 66. Accordingly, the main protrusions 72*a*, 72*b* and 72*c* do not excessively contact the discharge cap 66 but maintain a relatively uniform contact area. Since the main protrusions 72*a*, 72*b* and 72*c* and the auxiliary protrusions 74*a*, 74*b* and 74*c* evenly distribute the external force together, the product can be stably operated in spite of the excessive external force.

The invention claimed is:

1. A discharge valve assembly for a linear compressor which discharges a refrigerant compressed by a piston linearly reciprocated inside a cylinder, the discharge valve assembly, comprising:

a discharge valve installed at an end of the cylinder to be opened and closed;

a discharge cap fixedly installed at the end of the cylinder, for covering the cylinder and the discharge valve;

a discharge valve spring installed between the discharge valve and the discharge cap, for opening and closing the discharge valve according to a refrigerant pressure; and a discharge valve supporter installed in the discharge cap, having at least one main protrusion contacting the inner circumference of the discharge cap and at least one auxiliary protrusion isolated from the inner circumference of the discharge cap being formed on the outer circumference of the discharge valve supporter.

2. The discharge valve assembly of claim 1, wherein the plurality of main protrusions and the plurality of auxiliary protrusions are formed in point-symmetric positions on the outer circumference of the discharge valve supporter, respectively.

3. The discharge valve assembly of claim 1, wherein the plurality of main protrusions and the plurality of auxiliary protrusions are alternately formed on the outer circumference of the discharge valve supporter at intervals.

4. The discharge valve assembly of claim 1, wherein the main protrusions and the auxiliary protrusions are elongated in the axial direction of the discharge valve supporter.

5. The discharge valve assembly of claim 1, wherein the discharge valve supporter is made of a ductile material.

6. The discharge valve assembly of claim 1, wherein the discharge valve supporter is formed in a ring shape with an L-shaped section.

7. The discharge valve assembly of claim 1, wherein the discharge valve supporter is formed in an opened ring shape with an L-shaped section.

8. The discharge valve assembly of claim 1, wherein the main protrusions and the auxiliary protrusions have predetermined patterns, and the patterns form 120 rotation symmetry, respectively.

9. The discharge valve assembly of claim 1, wherein the discharge valve supporter comprises auxiliary protrusions formed in at least two sizes with different intervals from the inner circumference of the discharge cap.

10. The discharge valve assembly of claim 1, wherein the outside diameter of the discharge valve supporter is larger than the inside diameter of the discharge cap.

* * * * *